US006795672B2

(12) United States Patent
Yamamoto et al.

(10) Patent No.: US 6,795,672 B2
(45) Date of Patent: Sep. 21, 2004

(54) DEVELOPER REGULATING MEMBER AND DEVELOPING APPARATUS INCLUDING THE SAME

(75) Inventors: Shinya Yamamoto, Shizuoka (JP); Koichiro Takashima, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 10/079,894

(22) Filed: Feb. 22, 2002

(65) Prior Publication Data

US 2002/0159798 A1 Oct. 31, 2002

(30) Foreign Application Priority Data

Feb. 27, 2001 (JP) ..... 2001-052860

(51) Int. Cl.[7] ..... G03G 15/08
(52) U.S. Cl. ..... 399/284
(58) Field of Search ..... 399/274, 284, 399/283, 272, 273, 281

(56) References Cited

U.S. PATENT DOCUMENTS 4,566,991 A * 1/1986 Sibilia et al.
5,353,104 A * 10/1994 Kato et al. ..... 399/274
5,519,472 A * 5/1996 Ojima et al. ..... 399/274
5,570,166 A * 10/1996 Ohzeki et al. ..... 399/274
5,645,966 A * 7/1997 Koga
5,893,013 A 4/1999 Kinoshita et al. ..... 399/284
5,895,150 A * 4/1999 Watabe et al. ..... 399/284
5,999,784 A * 12/1999 Tsukida et al.
6,094,555 A * 7/2000 Katoh et al. ..... 399/284
6,115,575 A * 9/2000 Kinoshita et al.
6,528,158 B1 * 3/2003 Kuroda ..... 399/284

FOREIGN PATENT DOCUMENTS

| | | |
|---|---|---|
| EP | 0619530 | 10/1994 |
| EP | 1146399 | 10/2001 |
| JP | 8-328306 | 12/1996 |
| JP | 9-73225 | 3/1997 |

* cited by examiner

*Primary Examiner*—Susan Lee
(74) *Attorney, Agent, or Firm*—Fitzpatrick, Cella, Harper & Scinto

(57) ABSTRACT

A developer regulating member provided in a developing apparatus includes a metallic thin plate. The metallic thin plate is provided with polyamide elastomer having a thickness of 5 to 300 $\mu$m at an abutment portion thereof with a developing roller. With the above structure, occurrence of a fused product is prevented, and a stable developer thin layer is formed. Accordingly, occurrence of a number of fine streaks on formed images is prevented, and thus, images of high quality can be obtained.

54 Claims, 8 Drawing Sheets

DEVELOPER REGULATING MEMBER AND DEVELOPING APPARATUS INCLUDING THE SAME

BACKGROUND OF THE INVENTION

1. Field of the Invention

The present invention relates to a developer regulating member for regulating a developer and to a developing apparatus including the same. More particularly, it relates to a developer regulating member and to a developing apparatus suitable for use in an electrophotographic type image forming apparatus, for example, a copying machine, a printer or a facsimile machine.

2. Description of the Related Art

Hitherto, in such a type of image forming apparatus, an electrostatic latent image formed on an image bearing member has been visualized as a toner image by a developing apparatus.

As such a developing apparatus, for example, a dry one-component contact developing apparatus has been proposed and put to practical use. In this case, mostly, an electrostatic latent image is developed by pressing or contacting a rotating electrostatic latent image bearing member with a similarly rotating toner carrying member (developer carrying member) at a suitable relative peripheral velocity difference. In addition, the apparatus has many advantages. For example, no magnetic material is required so that the apparatus can be easily simplified and miniaturized. Furthermore, use of non-magnetic toner makes it possible to apply the apparatus to a full color image forming apparatus.

As the toner carrying member, a developing roller having elasticity and conductivity can be used. That is, since development is conducted by pressing or contacting it with the electrostatic latent image bearing member, the developing roller is made of an elastic material in order to prevent the electrostatic latent image bearing member from being damaged especially when it is a rigid member.

Also, the developing roller may be used by providing a conductive layer on a surface thereof or in the vicinity of the surface and applying a developing bias.

Further, for the purpose of imparting charges to the toner and forming a uniform thin layer of toner, a developing blade as a development regulating member may be abutted to the toner carrying member. In this case, it is possible to use an elastic blade made of rubber or a metallic thin plate having spring elasticity as the developing blade.

FIG. 8 shows a conventional developing apparatus.

A developing roller 81, which is a toner carrying member, is an elastic roller having conductivity, which has a base layer of silicone rubber having coated thereon acrylic urethane based rubber as a surface layer, It is rotatively driven in the direction as indicated by an arrow A.

A developing blade 82 is supported by a blade supporting sheet metal 83, and the vicinity of the leading end on the free end side of the developing blade contacts face to face with the peripheral surface of the developing roller 81.

Further, an elastic roller 84 is abutted to the developing roller 81 and is rotatively driven in the direction indicated by an arrow B. The elastic roller 84 is a sponge roller and is intended to supply toner to the developing roller 81 and scrape away the toner remaining on the developing roller undeveloped. The elastic roller 84 is arranged on the upstream side of the developing blade 82 in the rotational direction of the developing roller 81.

Toner 85 is a non-magnetic one-component developer. For the purpose of improving charging property and transfer property of toner, a suitable amount of hydrophobic silica is externally added.

In the developing apparatus of the above-mentioned structure, a satisfactory thin layer of the non-magnetic toner 85 can be formed on the developing roller 81 and an electrostatic latent image on the bearing member can be satisfactorily developed.

However, in the conventional technology as described above, it is desired to use toner having a smaller particle size or having an ensphered configuration for further improvement of high quality image. Repeating development operation by using such toner caused a problem in that an image failure of number of fine streaks is generated when a thin plate of metal such as SUS or phosphor bronze is used as a developing blade.

SUMMARY OF THE INVENTION

The present invention has been made in view of the above, and an object of the present invention is to provide a developer regulating member and a developing apparatus for forming a uniform layer of developer on a developer carrying member.

Another object of the present invention is to provide a developer regulating member and a developing apparatus in which the occurrence of a streak-like image failure in images is prevented.

Another object of the present invention is to provide a developer regulating member and a developing apparatus which can form satisfactory images even when toner having a reduced particle size or toner having an ensphered configuration is used.

Further objects and features of the present invention will become more apparent upon reading the following detailed description of the present invention with reference to the attached drawings.

DETAILED DESCRIPTION OF THE PREFERRED EMBODIMENTS

Hereinafter, a preferred embodiment of the present invention will be described in detail by way of examples. However, the size, material and shape as well as relative disposition of components described in the embodiment should be varied as appropriate depending on the structure of the apparatus to which the present invention is applied and various conditions, and the present invention should not be limited to the following embodiments.

Figure 1:
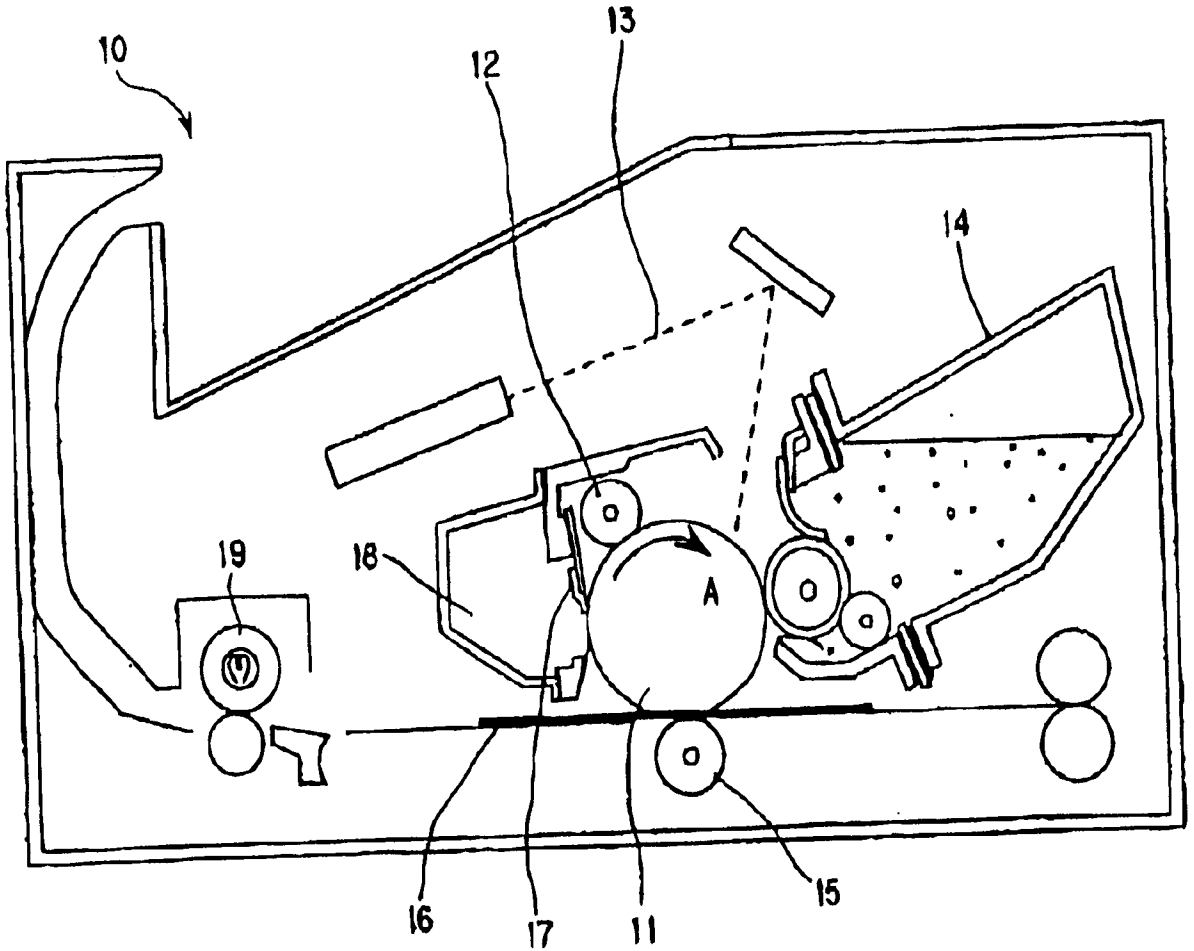
FIG. 1 is a schematic cross-sectional view showing an example of an image forming apparatus and a developing apparatus to which the present invention is applied.
Figure 2:
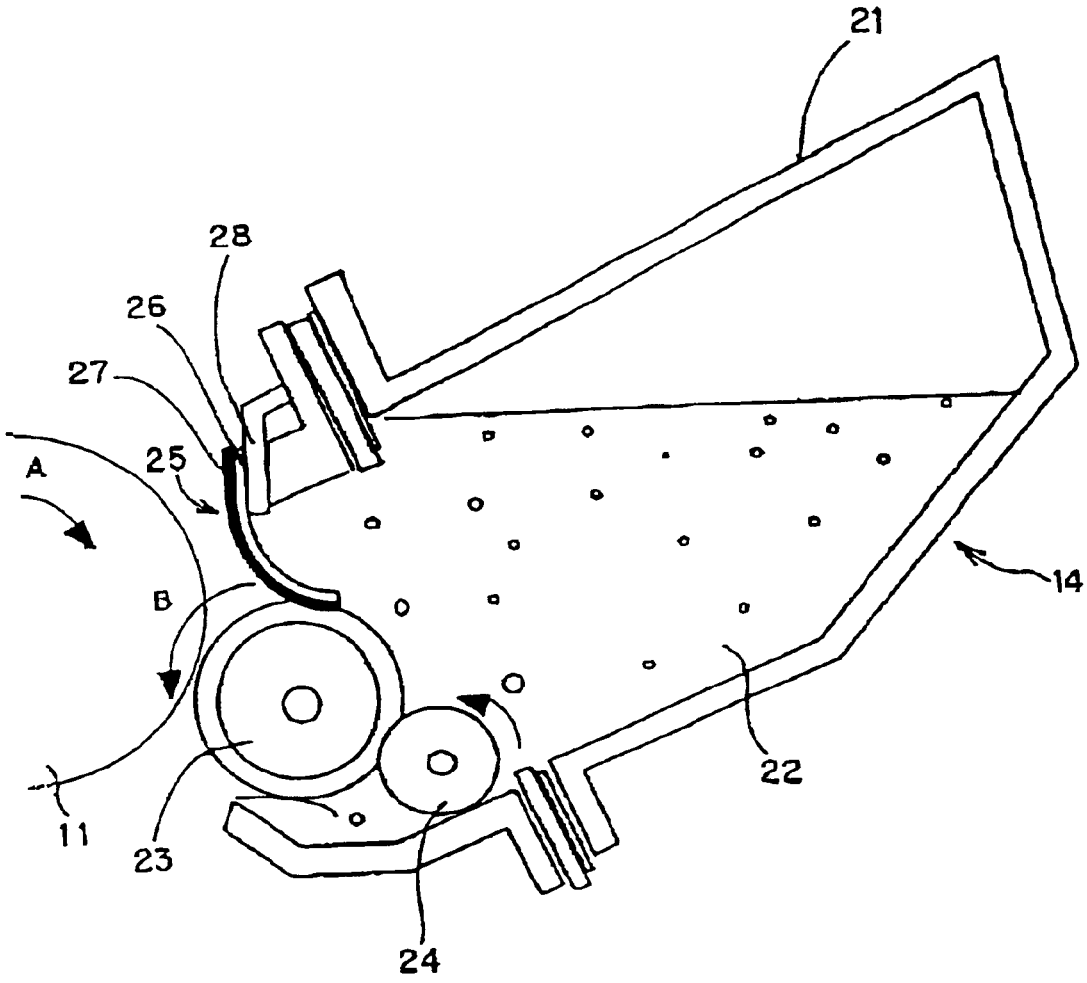
FIG. 2 is a schematic cross-sectional view showing the developing apparatus in FIG. 1.

FIG. 1 is a schematic cross-sectional view showing an image forming apparatus 10 to which the present invention is applied. FIG. 2 is a schematic cross-sectional view showing a developing apparatus.

First image forming operation will be explained by using an image forming means.

In FIG. 1 a photosensitive drum 11 as an electrostatic latent image bearing member rotates in the direction indicated by an arrow A. First, the photosensitive drum 11 is uniformly electrified by a charging apparatus 12. Thereafter, it is exposed to laser light 13 from a laser optical apparatus that is an exposure means to thereby form an electrostatic latent image on the surface thereof.

The electrostatic latent image is developed by a developing apparatus 14 arranged so as to be contacted with the photosensitive drum 11 and pressed against it to a predetermined depth to be visualized as a toner image.

The visualized toner image on the photosensitive drum 11 is transferred to a recording medium 16 as a transferring material by a transfer roller 15. The transfer residual toner that has not been transferred and remained on the photosensitive drum 11 is scraped away by a cleaning blade 17, which is a cleaning member, and contained in a waste toner container 18. The cleaned photosensitive drum 11 is repeatedly subjected to the above operation to perform image formation.

On the other hand, the recording medium 16 on which the toner image has been transferred is permanently fixed by a fixing apparatus 19 and discharged to the outside of the apparatus.

The developing apparatus 14 will be further described with reference to FIG. 2.

In FIG. 2, reference numeral 21 designates a developing container containing negatively charged non-magnetic toner 22 as a non-magnetic one-component developer. The developing apparatus 14 is provided with a developing roller 23 as a developer carrying member positioned at an opening portion longitudinally extending in the developing apparatus 21 and arranged so as to oppose the photosensitive drum 11 so that the electrostatic latent image on the photosensitive drum 11 can be developed and visualized.

The photosensitive drum 11 is a rigid member that includes an aluminum cylinder as a base and a photosensitive layer coated therearound to a predetermined thickness. Upon forming an image, the photosensitive drum 11 is uniformly electrified to a charge potential of Vd=−700 V by the charging apparatus and a portion exposed with laser based on an image signal is electrified to a charge potential of Vl=−150 V. To the Vl portion, direct current voltage of Vdc=−400 V is applied as a developing bias to a core metal of the developing roller 23 and the electrostatic latent image is subjected to reversal developing with the negatively charged toner.

The developing roller 23, which has elasticity, is arranged transversely such that a substantially right half circumference thereof is plunged into the developing container 21 and a substantially left half circumference thereof is exposed from the developing container 21. The surface exposed from the developing device 21 is opposed against the photosensitive drum 11 positioned leftward of the developing apparatus 14 so as to be contacted with and pressed against it to a predetermined depth. In this embodiment, the developing roller 23 is contacted with the photosensitive drum 11 and pressed against it to a depth of 50 $\mu$m.

The developing roller 23 is rotatively driven in the direction indicated by an arrow B. Its surface has appropriate unevenness in order to increase the possibility of rubbing and friction with the toner 22 and well perform transfer of the toner 22. In this embodiment, the developing roller 23 has a double layer structure including a base layer made of silicone rubber having coated on a surface thereof with acrylic urethane based rubber. It has a surface roughness of Rz (ten point average roughness)=10 $\mu$m and a resistance of $10^4$ to $10^6$ Ω.

Here, the method of measuring resistance will be described. The developing roller 23 is abutted to an aluminum sleeve having an identical diameter with that of the photosensitive drum 11 at an abutting load of 500 gf. The aluminum sleeve is rotated at an identical peripheral velocity with that of the photosensitive drum 11. In this embodiment, the photosensitive drum 11 is rotated at a peripheral velocity of 90 mm/sec and has a diameter of 30 mm while the developing roller 23 rotates at a peripheral velocity faster than that of the photosensitive drum 11, i.e., 120 mm/sec and has a diameter of 20 mm. Then, a direct current voltage of −400 V, which is identical with the developing bias in this embodiment, is applied to the developing roller 23. On this occasion, current is calculated by providing a resistor of 10 kΩ on the ground side and measuring the voltage across it, thereby calculating the resistance of the developing roller 23.

Below the developing roller 23, an elastic roller 24 is abutted and rotatably supported. It is preferred that the elastic roller 24 is of a sponge structure or of a fur brush structure made of a core metal having flocked fabric of fiber such as rayon or nylon in consideration of supply of toner to the developing roller 23 and scraping away of undeveloped toner therefrom. In this embodiment, the elastic roller 24 is a urethane sponge roller, which is rotatively driven in the same direction as the developing roller 23. The core metal, which is a rotation axis of the elastic roller, is at an identical potential with that of the developing roller 23. Therefore, when an electrostatic latent image on the photosensitive drum 11 is developed, an identical voltage as the developing bias will be applied to it.

In this embodiment, for the negatively charged non-magnetic toner 22 as a one-component developer, reduction in a particle size has been achieved in order to obtain high image quality, and substantially spherical toner is used in order to increase transfer efficiency. More specifically, toner having shape factors SF-1 of 100 to 180 and SF-2 of 100 to 140 is used.

The shape factors SF-1 and SF-2 are defined as the values obtained by the following formulas. More specifically, 100 toner images are randomly sampled with the use of Hitachi FE-SEM (S-800), and the obtained image data is introduced, for analysis, into an image analyzer (Luzex3: product of Nikoret Co.) through an interface.

$$SF\text{-}1=\{(MXLNG)^2/\mathrm{AREA}\}\times(\pi/4)\times 100$$

$$SF\text{-}2=\{(PERI)^2/\mathrm{AREA}\}\times(\pi/4)\times 100$$

(wherein MXLNG: absolute maximum length, AREA: projected area of toner, and PERI: peripheral length).

The surface factor SF-1 of toner represents degree of sphericity, and the greater the SF-1 of an object is relative to 100, the less spherical, or more undefined, the shape of the object is. The surface factor SF-2 represents degree of unevenness of a surface, and the greater the SF-2 of an object is relative to 100, more uneven the surface of the object is.

As to a method of manufacturing the toner, no particular method is sticked to, provided that the toner can keep the shape factors within the aforementioned ranges. For example, it is possible to perform plastic ensphering treatment of the surface of conventional pulverized toner by means of thermal or mechanical stress, or it is possible to use a method for directly producing toner with the use of the suspension polymerization method, a dispersion polymerization method for directly producing toner with the use of hydrous organic solvent in which monomer is soluble, but polymer is insoluble, an emulsion polymerization method, for example, a soap-free polymerization method for directly producing toner in the presence of water soluble, polar, polymerization initiator, or the like.

In this embodiment, a suspension polymerization method under the normal pressure or increased pressure is used. According to this method, it is possible to relatively easily control the shape factors SF-1 and SF-2 of the toner within ranges of 100–180 and 100–140, respectively, and also it is possible to obtain toner having a particle size within a range of 4 to 8 $\mu$m and having a sharp particle size distribution. Also, negatively charged toner having a weight average particle size of about 7 $\mu$m and containing 25% or less of toner particles having a weight average particle size of 4 $\mu$m or less is produced from a combination of styrene and n-butyl acrylate, as a monomer, a metallic salicylate compound as a charge controlling agent, a saturated polyester as polar resin, and also a coloring agent.

To measure the weight average particle size of toner, Coulter counter TAII type or Coulter Multilyzer (produced by Coulter Corp.) is used. As to the electrolytic solution, an aqueous 1% NaCl solution is prepared by using first grade sodium chloride. In 100 to 150 ml of the aqueous electrolytic solution, 0.1 to 5 ml of a surfactant, preferably alkylbenzenesulfonic acid salt as a dispersing agent is added and then 2 to 20 mg of a sample for measurement is added. The electrolytic solution in which the sample has been dispersed is subjected to dispersion treatment for about 1 to 3 minutes by using a supersonic disperser. The toner in the electrolytic solution subjected to the dispersion treatment is measured by using an aperture of 100 $\mu$m in the aforementioned measuring apparatus. More specifically, the volume and number of toner particles of 2 $\mu$m or more are measured to calculate volume distribution and number distribution, and a weight average particle size D4 is obtained from the volume distribution.

Thereafter, hydrophobic silica as a flowability improving agent is externally added by 1.5 wt % to the solution. Of course the addition amount is not limited to this. Coating the surface of toner particles with the external additive improves negative charge performance, and provision of micro interstices between the toner particles achieves improvement of the flowability.

Above the developing roller 23, a developing blade 25 as a developer regulating member having elasticity is provided so as to be supported by a supporting sheet metal 28 and abuts at its free end side in the vicinity of its leading end face to face the peripheral surface of the developing roller 23. The direction of abutment of the developing blade 25 to the developing roller 23 is in a counter direction in which the leading end on the free end side is positioned in the upstream side of the developing roller 23 in the rotational direction with respect to the abutment portion.

The developing blade 25 may be supported on the supporting sheet metal 28 by fastening with a machine screw or welding, and the supporting method is not particularly limited. The developing blade 25 and the supporting sheet metal 28 are at an identical potential to the developing roller 23. Therefore, when the electrostatic latent image on the photosensitive drum 11 is developed, a voltage identical to the developing bias will be applied.

The developing blade 25 has a phosphor bronze metallic thin plate 26 as a base which is laminated on its entire surface of abutment with the developing roller 23, that is, from the leading end on the side supported by the supporting sheet metal 28 to the free end side which contacts face to face the peripheral surface of the developing roller 23, with polyamide-containing rubber (hereinafter referred to as polyamide elastomer) 27 as an elastic member.

In this embodiment, the developing blade 25 is urged against the developing roller 23 with a pressure of 25 to 35 g/cm. Also, in consideration of the results described later on, the thickness of the phosphor bronze metallic thin plate 26 is set to 120 $\mu$m and the thickness of the polyamide elastomer 27 is set to 80 $\mu$m. That is, the thickness of the elastic member 27 is made thinner than the thickness of the base 26.

The polyamide elastomer is composed of polyamide and polyether bonded through an ester bond or amide bond.

There is no particular lamination on the polyamide component but nylon-6, nylon-6,6, nylon-6,12, nylon-11, nylon-12, nylon-12,12, or copolyamides obtained by polycondensation of monomers thereof, preferably those in which the terminal amino group of polyamide is carboxylated with a dibasic acid or the like are used. As the dibasic acid, saturated aliphatic dicarboxylic acids such as oxalic acid, succinic acid, adipic acid, suberic acid, sebacic acid, and dodecanedioic acid, unsaturated aliphatic dicarboxylic acids such as maleic acid, aromatic dicarboxylic acids such as phthalic acid and terephthalic acid, and polydicarboxylic acids composed of the above-mentioned dibasic acid and diol such as ethylene glycol, butanediol, hexanediol, or octanediol may be used. As the polyether component, polyethers such as homopolymerized or copolymerized polyethylene glycol, polypropylene glycol, and polytetramethylene glycol and polyether diamines in which both ends have been aminated may be used.

The polyamide elastomer used in this embodiment is obtained by reacting nylon-12 as the polyamide component, dodecanedioic acid as the dibasic acid, and polytetramethylene glycol as the polyether component, drying the product for a predetermined time, and then laminating it on a phosphor bronze metallic thin plate.

Using the above-described image forming apparatus 10 and developing apparatus 14, print out tests of 10,000 sheets were conducted under normal temperature and normal humidity (25° C., 60% RH) low temperature and low humidity (15° C., 10% RH), and high temperature and high humidity (30° C., 80% RH) environments. As a result, an image of high quality was obtained with no adhesion of a fused product on the surface of the developing blade abutting the developing roller and hence no generation of streak-like images, no generation of fog due to insufficient triboelectric ability to toner, and a stable image density with a constant amount of toner thin layer on the developing roller in the respective environments.

Hereinafter, the contents of the developer regulating member of the present invention will be described in more detail.

[Experiment 1]

When print out tests were conducted by using a conventional developing apparatus, the state of generation of streak-like images worsened in the order of low temperature and low humidity (15° C., 10% RH), normal temperature and normal humidity (25° C., 60% RH) and high temperature and high humidity (30° C., 80% RH) environments.

Observation indicated that a streak-like coating failure occurred on the developing roller corresponding to the streak-like image and the fused product was attached to the developing blade corresponding to the coating failure. Accordingly, it revealed that, because of the fused product on the developing blade, toner coating of the developing roller was disturbed so that a streak-like image failure occurred. Furthermore, the component of the fused product was found to be toner and hydrophobic silica.

Figure 3:
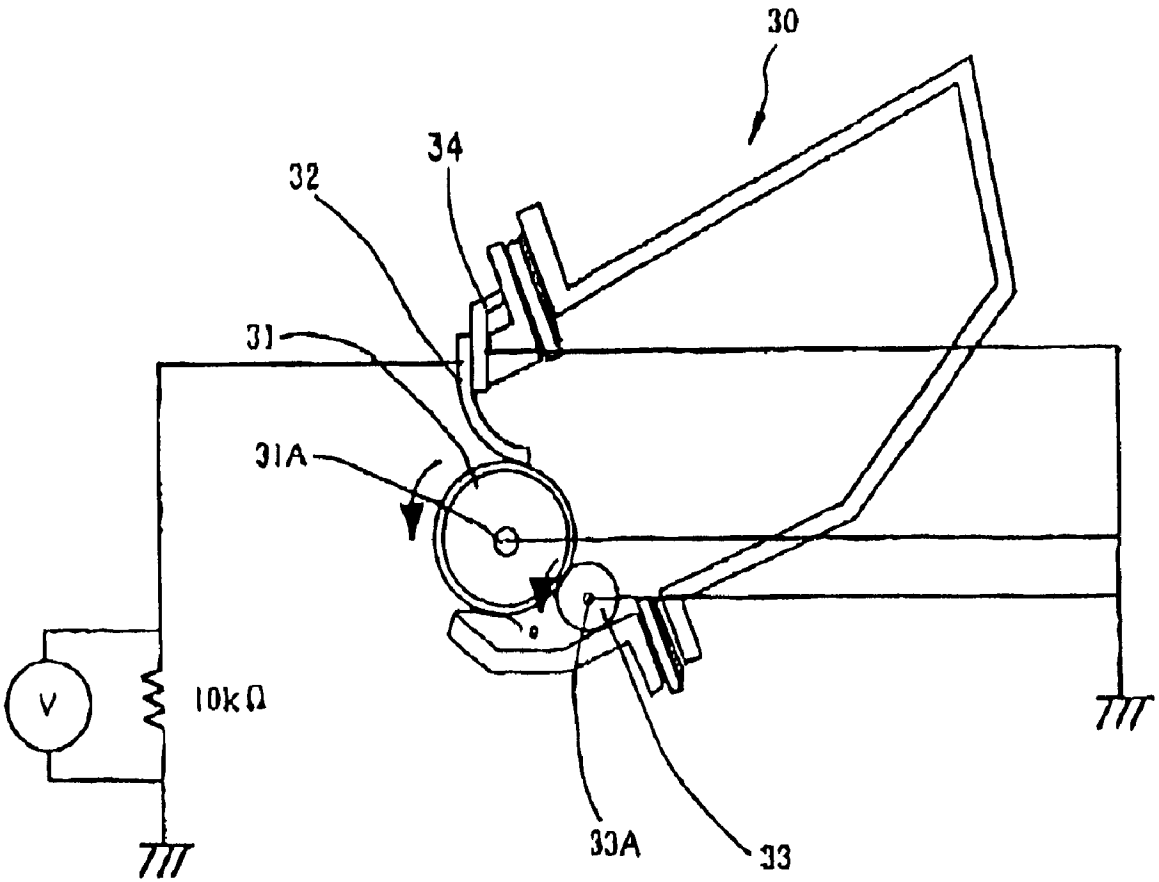
FIG. 3 is a schematic diagram of a laboratory device used in an embodiment of the present invention.

Accordingly, the present inventors considered the fusion relates to the charge of toner as the developer and is caused by an electric cause, and fabricated a test apparatus as shown in FIG. 3.

A developing device 30 is substantially the same as the conventional developing apparatus and is driven by a driving apparatus (not shown) to have toner as the developer carried on a developing roller 31. A developing blade 32 is a phosphor bronze metallic thin plate and abuts the developing roller 31 in a counter direction. A urethane sponge-made elastic roller 33 abuts the developing roller 31 with being pressed to a predetermined depth and rotates in the same direction as the developing roller 31. A core metal 31A, which is a rotation axis of the developing roller 31, a core metal 33A, which is a rotation axis of the elastic roller 33, the developing blade 32, and a supporting sheet metal 34 supporting it are conducting so as to be at an identical potential and grounded as shown in FIG. 3. Further, a resistor of 10 kΩ is provided between the developing blade 32 and the ground and the current flowing between the developing roller 31 and the developing blade 32 is calculated by measuring the voltages across the resistor.

At the same time, the charged amount of toner under each environment is measured.

The method of measuring the charged amount of toner is performed by using EFV200/300 (produced by Powdertech Co.) as a carrier and introducing 10.0 g of the carrier and 0.2 g of toner in a 50 ml capacity polyethylene container, followed by shaking it by the hand 90 times.

Figure 4:
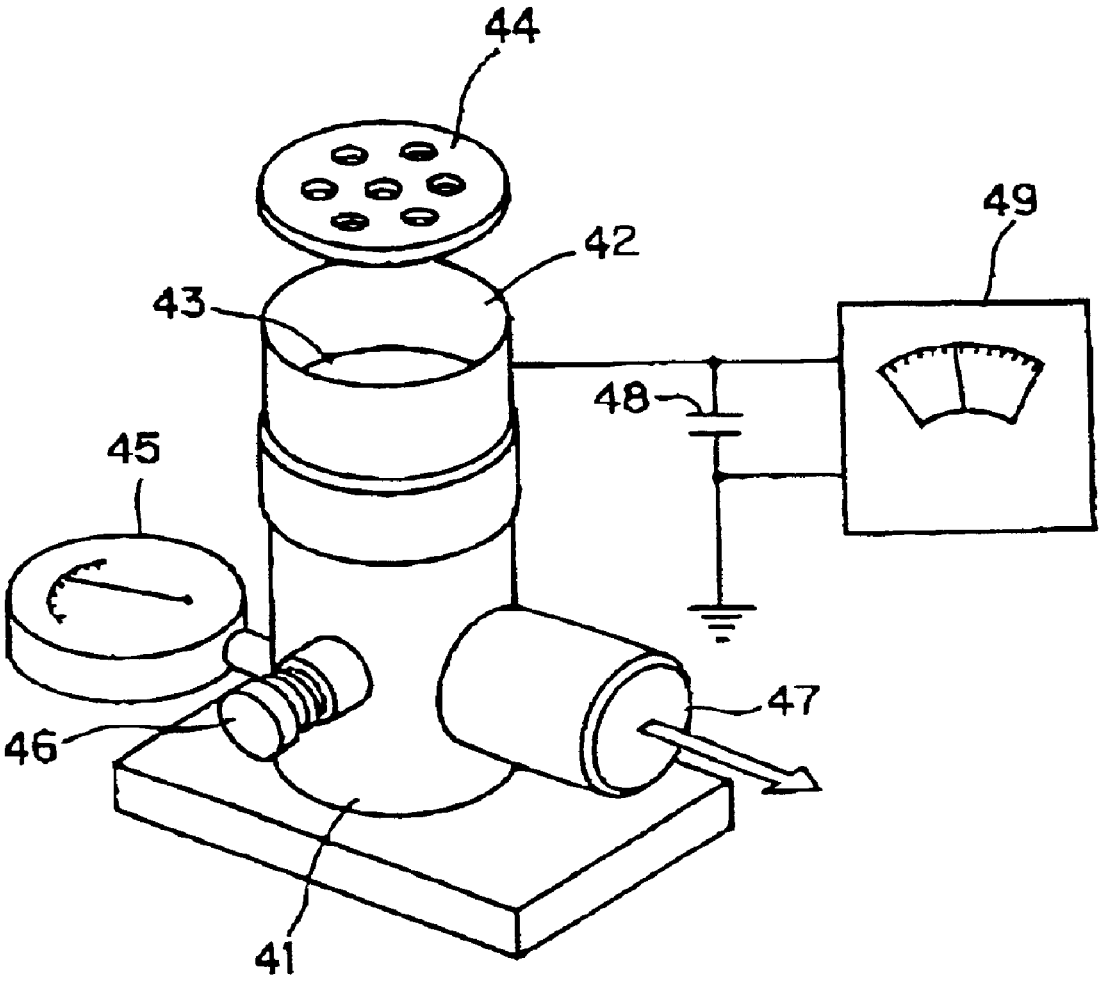
FIG. 4 is a schematic diagram showing a device for measuring the charge amount of toner.

Then, about 1 g of the aforementioned mixture is placed in a metallic measuring container 42 having a 500 mesh screen 43 on the bottom as shown in FIG. 4 and a metallic lid is placed on it. The total weight of the measuring container 42 in this state is defined as W1 (g).

Next, the measuring container 42 is placed in an absorber (having an insulating member corresponding to the portion where it contacts the measuring container 42) and the air is sucked through a sucking port 47 at a pressure of 2,450 Pa. In this state, the sucking is continued for 2 minutes, and the toner is sucked and removed. The potential of a potentiometer 49 at this time is defined V (volt) Here, reference numeral 48 designates a capacitor, whose capacitance is defined C (mF). The total weight of the measuring container 42 of the absorber measured is defined W2 (g).

The charged amount of toner T (mC/kg) is obtained according to the formula $$\text{Charged amount } T\ (mC/kg) = C \times V/(W1 - W2).$$

Table 1 shows the measurement results under the respective environments.

TABLE 1

| Environment | Current (μA) | Charged amounts of toner (mC/kg) |
|---|---|---|
| Low temperature and low humidity | 8 | −80 |
| Normal temperature and normal humidity | 5 | −50 |
| High temperature and high humidity | 2 | −20 |

The measured current values and charged amounts of toner are greater in the order of low temperature and low humidity (15° C., 10% RH), normal temperature and normal humidity (25° C., 60% RH) and high temperature and high humidity (30° C., 80% RH) environments, in which order the state of occurrence of the fused product on the developing blade is worsened. The current flows from the developing blade 32 to the developing roller 31.

Then, in order to examine the influence of the current flowing from the developing blade 32 to the developing roller 31 on the occurrence of the fused product on the developing blade 32, the resistance of the developing blade 32 was varied.

For the measurement of current, the aforementioned test apparatus was used. Also, the developing blade 32 having the varied resistance was used in the conventional developing apparatus and a sheet feeding test of 2,000 sheets was conducted under low temperature and low humidity (15° C., 10% RH) environment and the state of occurrence of the fused product on the developing blade 32 was observed.

The resistance of the developing blade 32 was varied by providing a resistance layer on a metallic thin plate at the abutment surface between the developing blade 32 and the developing roller 31 and varying the resistance of the resistance layer. The resistance layer was adjusted so as to have a predetermined resistance by dispersing carbon particles, which are conductive agent, in a phenol resin in a varied carbon amount.

The test results are shown in Table 2.

TABLE 2

| Resistance (Ω) | Current (μA) | Occurrence of fusion |
|---|---|---|
| 0 (Phosphor bronze) | 6 | Occurred |
| $10^2$ | 0.1 | Slightly occurred |
| $10^4$ | 0 | None |
| $10^6$ | 0 | None |

At a resistance of $10^3$ Ω or less, a current flow was detected in the developing blade and fusion occurred at the abutment surface between the developing blade 32 and the developing roller 31.

The above results indicate that occurrence of fusion on the developing blade is due to the current that flows between the developing roller and the developing blade, and the toner having negative charge attaches to the developing blade because of its polarity and further fuses to the developing blade by friction with the developing roller to cause an image failure.

Then, an elastic blade was constructed by using a polyamide elastomer having a resistance of about $10^9$ Ω and containing a polyamide component having a satisfactory triboelectric ability to toner having negative polarity and a polyether component having elasticity.

Figure 5:
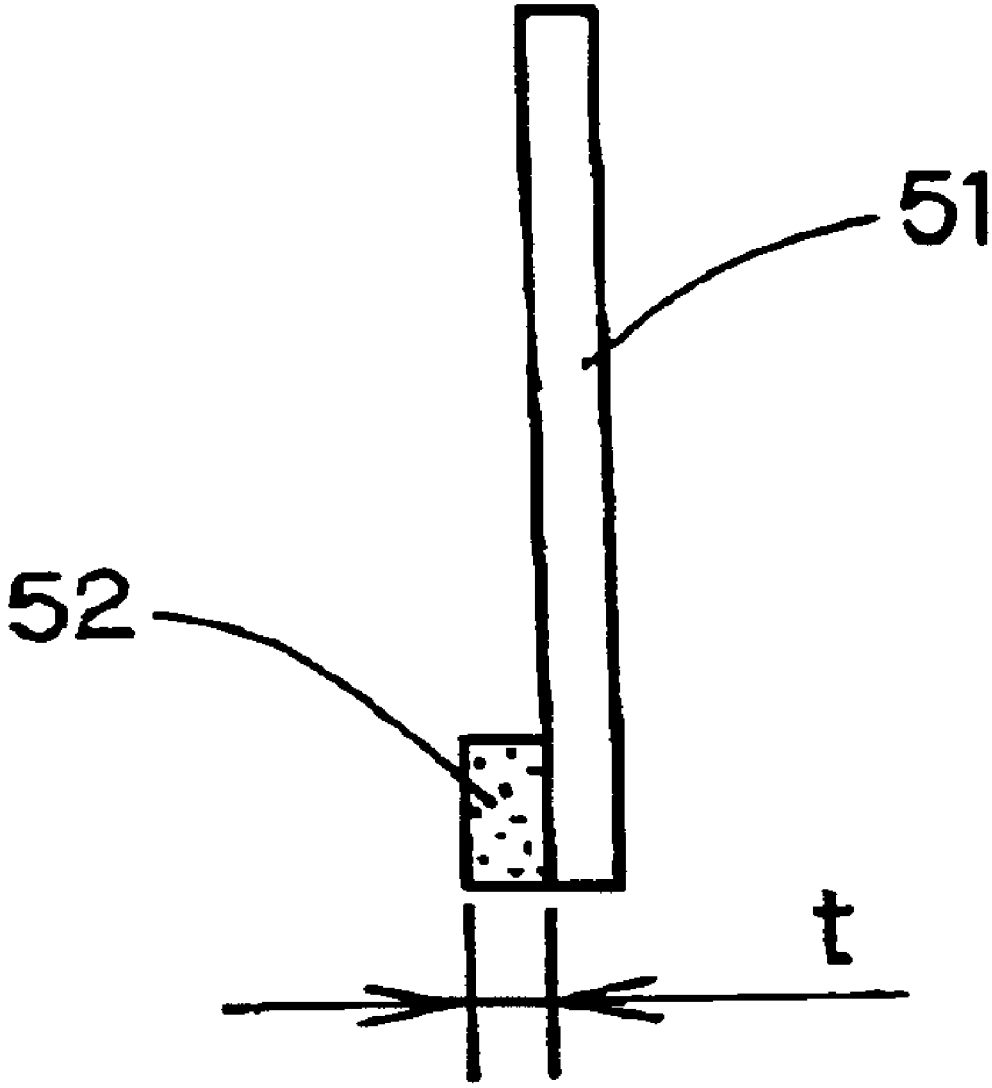
FIG. 5 is a schematic cross-sectional view showing a developer regulating member to which the present invention is applied.
Figure 6:
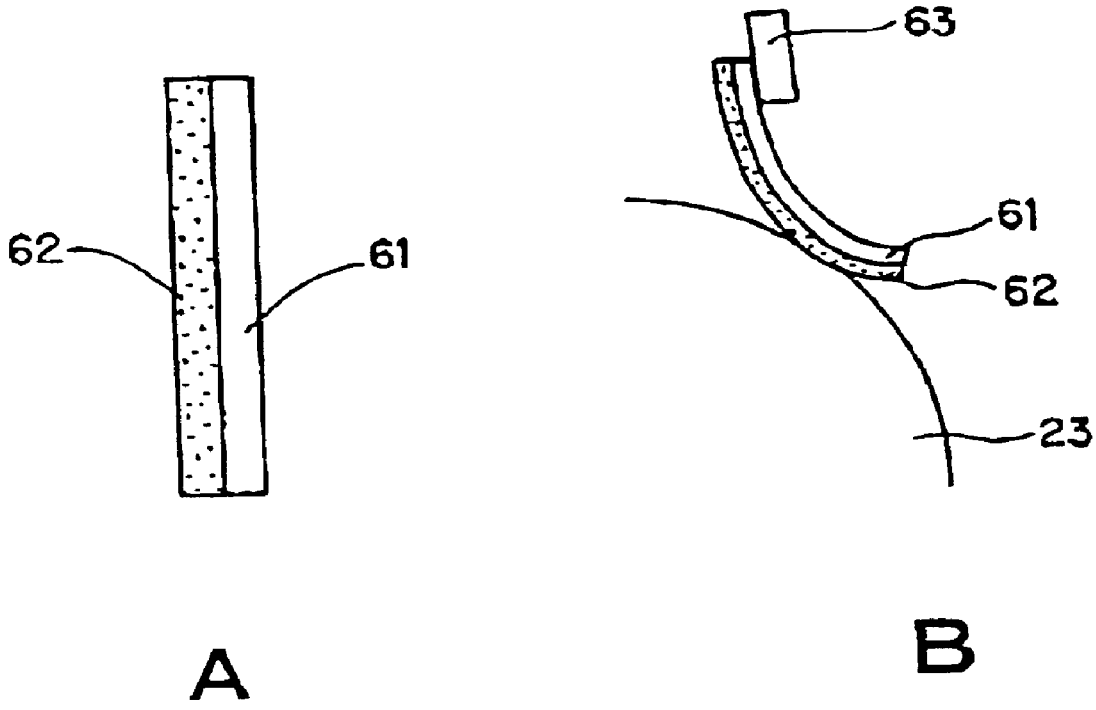
FIGS. 6A and 6B are a schematic cross-sectional view of an example of the developer regulating member, and a schematic cross-sectional view of the example of the developer regulating member illustrating a state where it is supported by a supporting sheet metal 63 and contacts face to face with the peripheral surface of a developing roller 23, respectively.

On this occasion, as shown in FIG. 5, a polyamide elastomer 52 was molded to a thickness of 1 mm on a 100

μm thick phosphor bronze metallic thin plate 51 having spring characteristics. More specifically, by using nylon-12 as the polyamide component obtained by reaction with dodecanedioic acid as the dibasic acid and polytetramethylene glycol as the polyether component, it was synthesized and after drying for a predetermined time, it was integrally molded by injection molding using a mold equipped with the metallic thin plate 51 at a melting temperature of 200° C. and a mold temperature of 30° C.

As a result of the sheet feeding test of 10,000 sheets by using this developing blade under low temperature and low humidity (15° C., 10% RH) environment, images of good quality with no fog were obtained with occurrence of no fusion on the developing blade and with high triboelectric charge imparting property due to high triboelectric charging ability of the developing blade itself.

[Experiment 2]

However, the results of the sheet feeding tests of 10,000 sheets by using the aforementioned developing blade including the 100 μm thick phosphor bronze metallic thin plate having molded thereon polyamide elastomer to a thickness of 1 mm under low temperature and low humidity (15° C., 10% RH), normal temperature and normal humidity (25° C., 60% RH) and high temperature and high humidity (30° C., 80% RH) environments indicated that no attachment of a fused product occurred in each environment but that in some cases image density varied from environment to environment.

The reason for different image density from environment to environment was due to the fact that the thickness of the toner thin layer formed under regulation by the developing blade on the developing roller as the toner carrying member was different from environment to environment. More specifically, comparison of the weight of toner per unit area on the developing roller among the environments resulted as shown in Table 3.

TABLE 3

| Environment | Weight of toner on developing roller ($mg/cm^2$) |
|---|---|
| Low temperature and low humidity | 0.70 |
| Normal temperature and normal humidity | 0.50 |
| High temperature and high humidity | 0.35 |

To investigate the cause of this, experiments were conducted repeatedly and the following was found.

(1) When a metallic thin plate made of phosphor bronze or the like is used as a developing blade, no phenomenon that the weight of toner per unit area on the developing roller may differ from environment to environment is observed; and (2) In the case of toner with a reduced particle size and ensphered configuration, the phenomenon that the weight of toner per unit area on the developing roller differs from environment to environment is significant.

These results indicate that in the construction in which the developing roller having elasticity and the developing blade having rubber elasticity, for example polyamide elastomer abut to each other at the abutment portion between the developing blade and the developing roller, when it is attempted to regulate toner having a reduced particle size and ensphered configuration, more specifically, toner having a weight average particle size of about 7 μm and shape factors SF-1 of 100 to 180 and SF-2 of 100 to 140 to thereby form a toner thin layer on the developing roller, the toner on the developing roller cannot be regulated well by the developing blade because both the elastic members are susceptible to deformation and toner having a reduced particle size and ensphered configuration is used.

It revealed that such a construction is susceptible to influences of changes in toner characteristics from environment to environment, for example, flowability.

In the case where either one of them is a rigid member, for example, where the developing blade made of a metallic thin plate is used for the developing roller having elasticity, the developing blade provided with an elastic member at the abutment portion with respect to a metallic developing sleeve can form a stable toner thin layer on the toner carrying member.

To solve this problem, the thickness t of the polyamide elastomer molded on the metallic thin plate was varied and the weight of toner per unit area on the developing roller was measured under each environment.

On this occasion, phosphor bronze was used for the metallic thin plate, which had a thickness of 100 μm. The abutting pressure between each developing blade and the developing roller at normal temperature and normal humidity was set to 25 g/cm uniformly.

The results obtained are shown in Table 4.

TABLE 4

| | Weight of toner per unit area on developing roller ($mg/cm^2$) | | |
|---|---|---|---|
| Thickness t (μm) | Low temperature and low humidity | Normal temperature and normal humidity | High temperature and high humidity |
| 1000 | 0.70 | 0.50 | 0.35 |
| 500 | 0.68 | 0.52 | 0.38 |
| 200 | 0.55 | 0.50 | 0.46 |
| 300 | 0.51 | 0.49 | 0.48 |
| 100 | 0.50 | 0.51 | 0.51 |
| 20 | 0.52 | 0.49 | 0.49 |
| 5 | 0.49 | 0.48 | 0.50 |

When the thickness t is 500 μm or more, a difference in the weight of toner between the low temperature and low humidity environment in which the weight of toner per unit area on the developing roller is the largest and the high temperature and high humidity environment in which the weight of toner per unit area on the developing roller is the smallest is 0.3 or more. In contrast, when the thickness t is t=300 μm or less, such a difference is 0.1 or less. In particular, when t=200 μm or less, a difference in the weight of toner depending on the environment can be said to be substantially none.

The reason for this is that by reducing the thickness of polyamide elastomer, which is an elastic member, it becomes difficult to deform as the elastic member and similarly to the case where a developing blade made of a metallic thin plate is used with respect to a developing roller having elasticity, the toner on the developing roller can be well regulated by the developing blade even when toner having a reduced particle size and ensphered configuration is used.

Further, experiments were also conducted by using the aforementioned developing blade with polyamide elastomer of a thickness t=2 μm. On this occasion, insulating property was damaged due to fish eye or bubbles generated at the time of molding polyamide elastomer, so that the function as a resistance layer was not achieved. Therefore, fusion occurred at the defective portion.

Accordingly, the range of appropriate thickness of the elastic body is 5 μm<t<300 μm, preferably 5 μm<t<200 μm. The shape of the developing blade may be such that an elastic member 62 is provided over the entire surface from the leading end of a metallic thin plate 61 on the side supported by a supporting sheet metal 63 to the free end side that contacts face to face the peripheral surface of the developing roller 23.

In addition, it is preferred that the toner includes particles having a weight average particle size of 4 μm or less in a number percentage of 30% or less. When the number percentage of particles having a weight average particle size of 4 μm or less is more than 30%, the toner charge amount increases so that fusion tends to occur very easily and the weight average particle size becomes relatively small, so that it becomes difficult to regulate toner and form a thin layer.

Based on the results described above, print-out tests of 10,000 sheets were conducted by abutting a developing blade, in which polyamide elastomer of a thickness t=80 μm is integrally molded over the entire surface of a 120 μm thick metallic thin plate, from the leading end of the metallic thin plate on the side supported by a supporting sheet metal to the free end side that contacts face to face the peripheral surface of a developing roller, the developing roller at an abutting pressure of 30 g/cm and using toner of which number percentage of toner particles having a weight average particle size of 4 μm or less is 30% under low temperature and low humidity, normal temperature and normal humidity, and high temperature and high humidity environments. As a result, a stable, uniform toner thin layer could be formed without generating streak-like image due to fused product from the beginning to the end. Thus, stable, satisfactory image quality of which the image density showed no variation from the environment to the environment could be obtained.

Figure 7:
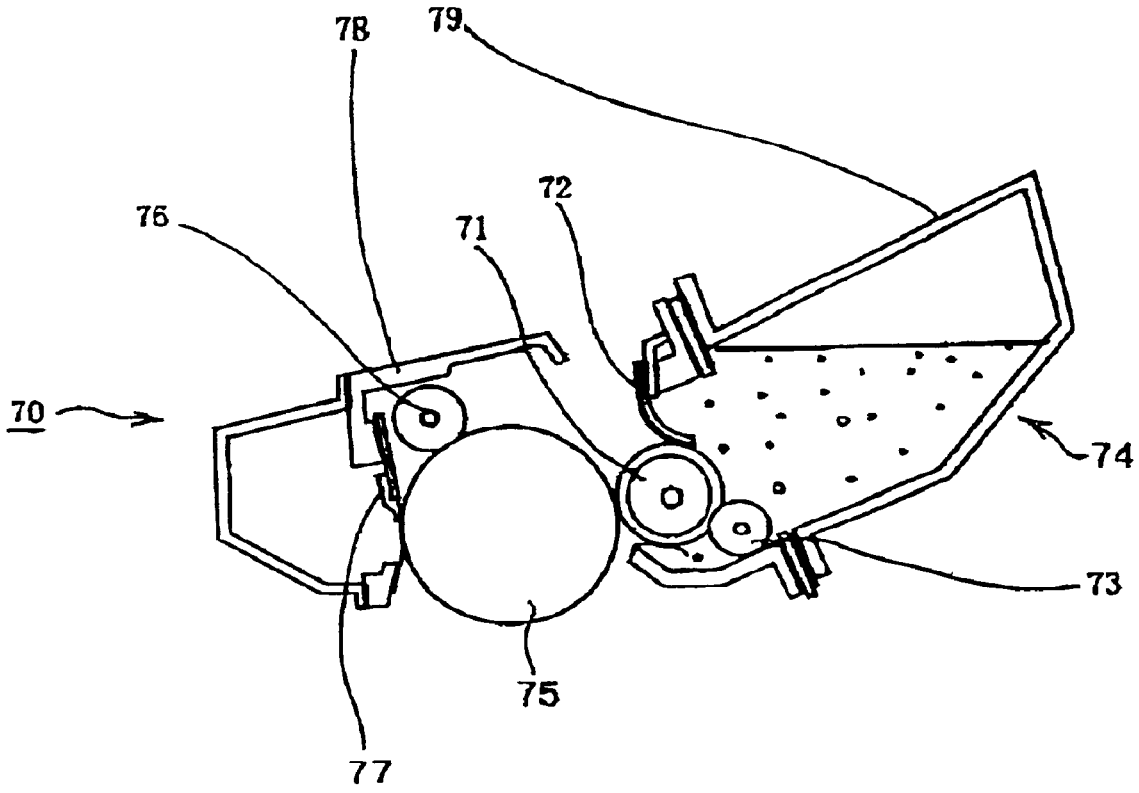
FIG. 7 is a schematic cross-sectional view showing an example of a process cartridge to which the present invention is applied.
Figure 8:
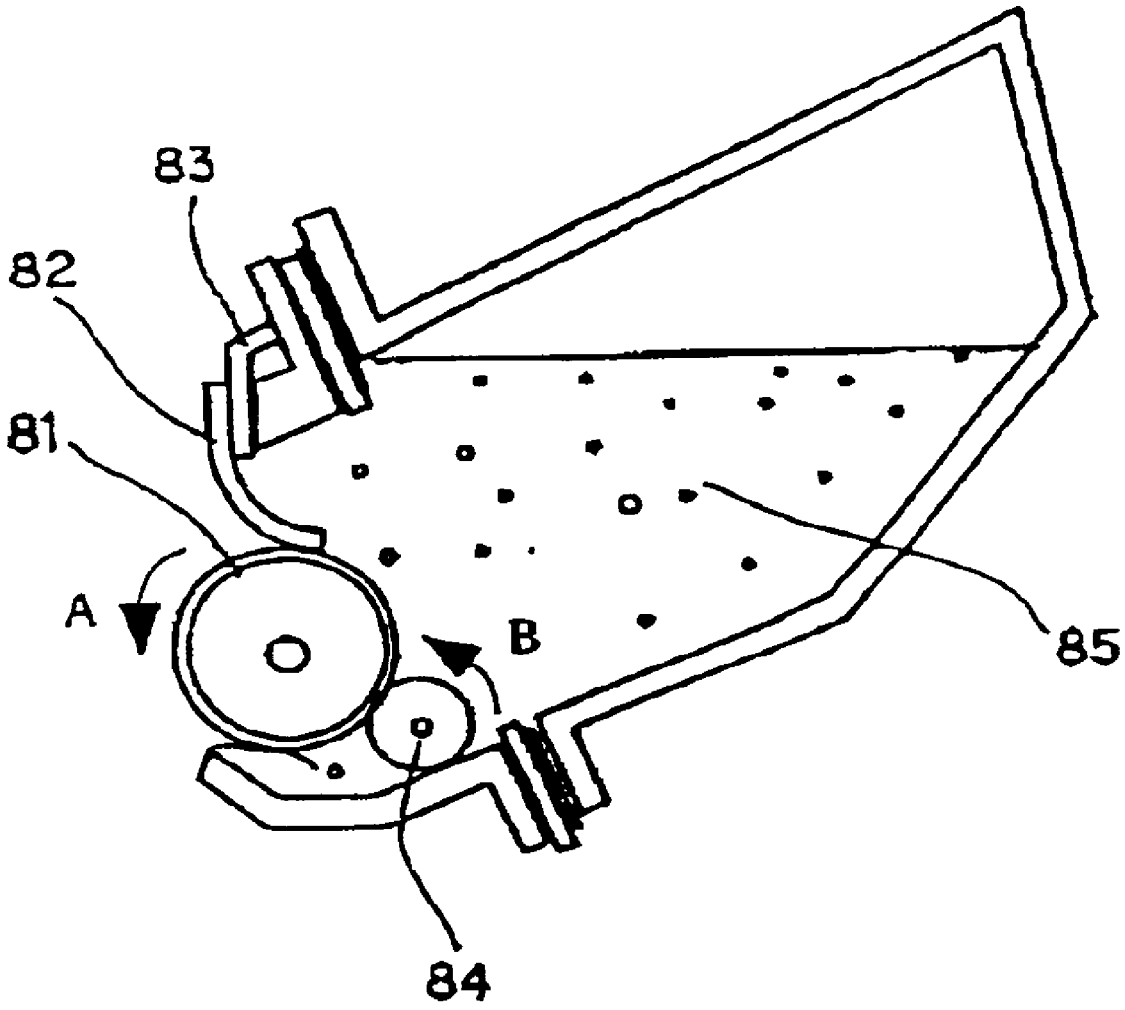
FIG. 8 is a schematic cross-sectional view showing a conventional developing apparatus.

FIG. 7 is a schematic cross-sectional view showing an example of a process cartridge to which the developer regulating member and developing apparatus of the present invention are applied.

A process cartridge 70 is detachably attachable to the body of an image forming apparatus and includes a developing apparatus 74 having a developing roller 71 as a developer carrying member, a developer regulating member 72 provided so as to face to face abut the peripheral surface of the developing roller 71, an elastic roller 73, and the like, a photosensitive drum 75 as an image bearing member, a charging means 76, and a cleaning means 77, and further is integrally fabricated into a cartridge by use of developing frame members 78 and 79 made of plastic.

That is, the process cartridge 70 of this embodiment includes the aforementioned developing apparatus 74 and the process constituent part operating on the photosensitive drum 75 as an integral unit. Therefore, all of the aforementioned constituent parts are similarly applied in the process cartridge 70 and the process cartridge 70 is provided in the image forming apparatus in a detachably attachable manner.

As described above, occurrence of fused product can be prevented by the developer regulating member to which the present invention is applied, so that the conventional problem of the occurrence of an image failure of a number of fine streaks can be prevented.

Therefore, under each environment, a stable developer thin layer can be formed so that it is possible to provide an apparatus that can provide high quality images with stable image density.

What is claimed is:

1. A developer regulating member for regulating the amount of developer carried on a developer carrying member, comprising:

a base; and an elastic member provided on said base and pressed against said developer carrying member, said elastic member containing a polyamide and having a thickness of 5 to 300 μm, wherein:

(i) the elastic member contacts the developer carrying member; and (ii) the elastic member is a polyamide elastomer.

2. A developer regulating member according to claim 1, wherein said elastic member has a thickness of 5 to 200 μm.

3. A developer regulating member according to claim 1, wherein said elastic member comprises rubber.

4. A developer regulating member according to claim 1, wherein said base comprises an elastic plate.

5. A developer regulating member according to claim 1 or 4, wherein said base comprises a metal.

6. A developer regulating member according to claim 1, wherein the thickness of said elastic member is smaller than that of said base.

7. A developer regulating member according to claim 1, wherein said developer regulating member is urged against said developer carrying member with a pressure of 25 to 35 g/cm.

8. A developer regulating member according to claim 1, wherein said elastic member contains polyether.

9. A developer regulating member according to claim 8, wherein said elastic member comprises the polyamide and polyether bonded through an ester bond or amide bond.

10. A developer regulating member according to claim 1, wherein the developer is a non-magnetic one-component developer.

11. A developer regulating member according to claim 10, wherein the developer is toner having shape factors SF-1 of 100 to 180 and SF-2 of 100 to 140.

12. A developer regulating member according to claim 10, wherein the developer has a number percentage of toner particles having a weight average particle size of 4 μm or less of 30% or less.

13. A developer regulating member for regulating an amount of developer carried on a developer carrying member, comprising:

a base; and an elastic member provided on said base and pressed against said developer carrying member, said elastic member having a resistance of $10^4$ Ω or more and a thickness of 300 μm or less, wherein:

(i) the elastic member contacts the developer carrying member; and (ii) the elastic member is a polyamide elastomer.

14. A developer regulating member according to claim 13, wherein said elastic member has a thickness of 5 to 200 μm.

15. A developer regulating member according to claim 13, wherein said elastic member comprises rubber.

16. A developer regulating member according to claim 13, wherein said base comprises an elastic plate.

17. A developer regulating member according to claim 13 or 16, wherein said base comprises a metal.

18. A developer regulating member according to claim 13, wherein the thickness of said elastic member is smaller than that of said base.

19. A developer regulating member according to claim 13, wherein said developer regulating member is urged against said developer carrying member with a pressure of 25 to 35 g/cm.

20. A developer regulating member according to claim 13, wherein said elastic member contains a polyether.

21. A developer regulating member according to claim 20, wherein said elastic member comprises the polyamide and polyether bonded through an ester bond or amide bond.

22. A developer regulating member according to claim 13, wherein the developer is a non-magnetic one-component developer.

23. A developer regulating member according to claim 22, wherein the developer is toner having shape factors SF-1 of 100 to 180 and SF-2 of 100 to 140.

24. A developer regulating member according to claim 22, wherein the developer has a number percentage of toner particles having a weight average particle size of 4 $\mu$m or less of 30% or less.

25. A developing apparatus comprising:

a developer carrying member for carrying a developer, said developer carrying member developing an electrostatic image formed on an image bearing member with the developer; and a developer regulating member for regulating an amount of the developer carried on said developer carrying member, which said developer regulating member comprises:

a base; and an elastic member provided on said base and pressed against said developer carrying member, said elastic member having a resistance of $10^4$ Ω or more and a thickness of 300 $\mu$m or less, wherein:

(i) the elastic member contacts the developer carrying member: and (ii) the elastic member is a polyamide elastomer.

26. A developing apparatus according to claim 25, wherein said developer regulating member has a potential identical with that of said developer carrying member.

27. A developing apparatus according to claim 25, wherein said elastic member has a thickness of 5 to 200 $\mu$m.

28. A developing apparatus according to claim 25, wherein said elastic member comprises rubber.

29. A developing apparatus according to claim 25, wherein said base comprises an elastic plate.

30. A developing apparatus according to claim 25 or 29, wherein said base comprises a metal.

31. A developing apparatus according to claim 25, wherein the thickness of said elastic member is smaller than that of said base.

32. A developing apparatus according to claim 25, wherein said developer regulating member is urged against said developer carrying member with a pressure of 25 to 35 g/cm.

33. A developing apparatus according to claim 25, wherein said elastic member contains a polyether.

34. A developing apparatus according to claim 33, wherein said elastic member comprises the polyamide and polyether bonded through an ester bond or amide bond.

35. A developing apparatus according to claim 25, wherein the developer is a non-magnetic one-component developer.

36. A developing apparatus according to claim 35, wherein the developer is toner having shape factors SF-1 of 100 to 180 and SF-2 of 100 to 140.

37. A developing apparatus according to claim 35, wherein the developer has a number percentage of toner particles having a weight average particle size of 4 $\mu$m or less of 30% or less.

38. A developing apparatus according to claim 25, wherein said developing apparatus together with said image bearing member is provided in a process cartridge detachably attachable to a body of an image forming apparatus.

39. A developing apparatus according to claim 25, wherein said developer carrying member is an elastic member.

40. A developing apparatus comprising:

a developer carrying member for carrying a developer, said developer carrying member developing an electrostatic image formed on an image bearing member with the developer; and a developer regulating member for regulating an amount of the developer carried on said developer carrying member, which said developer regulating member comprises:

a base; and an elastic member provided on said base and pressed against said developer carrying member, said elastic member containing a contains polyamide and having a thickness of 5 to 300 λm, wherein:

(i) the elastic member contacts the developer carrying member; and (ii) the elastic member is a polyamide elastomer.

41. A developing apparatus according to claim 40, wherein said developer regulating member has a potential identical with that of said developer carrying member.

42. A developing apparatus according to claim 40, wherein said elastic member has a thickness of 5 to 200 $\mu$m.

43. A developing apparatus according to claim 40, wherein said elastic member comprises rubber.

44. A developing apparatus according to claim 40, wherein said base comprises an elastic plate.

45. A developing apparatus according to claim 40 or 44, wherein said base comprises a metal.

46. A developing apparatus according to claim 40, wherein the thickness of said elastic member is smaller than that of said base.

47. A developing apparatus according to claim 40, wherein said developer regulating member is urged against said developer carrying member with a pressure of 25 to 35 g/cm.

48. A developing apparatus according to claim 40, wherein said elastic member contains polyether.

49. A developing apparatus according of claim 48, wherein said elastic member comprises the polyamide and polyether bonded through an ester bond or amide bond.

50. A developing apparatus according to claim 40, wherein the developer is a non-magnetic one-component developer.

51. A developing apparatus according to claim 50, wherein the developer is toner having shape factors SF-1 of 100 to 180 and SF-2 of 100 to 140.

52. A developing apparatus according to claim 50, wherein the developer has a number percentage of toner particles having a weight average particle size of 4 $\mu$m or less of 30% or less.

53. A developing apparatus according to claim 40, wherein said developing apparatus together with said image bearing member is provided in a process cartridge detachably attachable to a body of an image forming apparatus.

54. A developing apparatus according to claim 40, wherein said developer carrying member is an elastic member.

* * * * *

UNITED STATES PATENT AND TRADEMARK OFFICE

CERTIFICATE OF CORRECTION

PATENT NO. : 6,795,672 B2
DATED : September 21, 2004
INVENTOR(S) : Shinya Yamamoto et al.

It is certified that error appears in the above-identified patent and that said Letters Patent is hereby corrected as shown below:

Column 10,
Lines 35-36, "Thickness t(μm) should read -- Thickness t(μm)

| | |
|---|---|
| 1000 | 1000 |
| 500 | 500 |
| 200 | 300 |
| 300 | 200 |
| 100 | 100 |
| 20 | 20 |
| 5" | 5 --. |

Column 13,
Line 34, "member:" should read -- member; --.

Column 14,
Line 21, "contains" should be deleted; and
Line 22, "300 λm," should read -- 300 μm, --.

Signed and Sealed this

Nineteenth Day of April, 2005

JON W. DUDAS
*Director of the United States Patent and Trademark Office*